US007249813B2

(12) United States Patent
Gasser

(10) Patent No.: US 7,249,813 B2
(45) Date of Patent: Jul. 31, 2007

(54) RETRACTION DEVICE FOR DRAWERS

(75) Inventor: Ingo Gasser, Höchst (AT)

(73) Assignee: Julius Blum Gesellschaft m.b.H., Hochst (AT)

( * ) Notice: Subject to any disclaimer, the term of this patent is extended or adjusted under 35 U.S.C. 154(b) by 389 days.

(21) Appl. No.: 10/798,423

(22) Filed: Mar. 12, 2004

(65) Prior Publication Data

US 2004/0212283 A1 Oct. 28, 2004

(30) Foreign Application Priority Data

Apr. 25, 2003 (AT) ..... A 630/2003

(51) Int. Cl.
*A47B 88/00* (2006.01)

(52) U.S. Cl. ..... 312/333

(58) Field of Classification Search ..... 312/333, 312/319.1, 334.7, 334.14, 334.1
See application file for complete search history.

(56) References Cited

U.S. PATENT DOCUMENTS 5,364,179 A * 11/1994 Brustle et al. ..... 312/333
5,392,951 A * 2/1995 Gardner et al. ..... 312/319.5
6,736,471 B2 * 5/2004 Lin ..... 312/333
6,953,233 B2 * 10/2005 Lam et al. ..... 312/333
6,979,066 B2 * 12/2005 Yang ..... 312/333
6,997,528 B2 * 2/2006 Yang ..... 312/333
7,028,370 B2 * 4/2006 Hoshide et al. ..... 16/96 R
2001/0008037 A1 * 7/2001 Brustle ..... 16/71
2004/0000850 A1 * 1/2004 Harn et al. ..... 312/333
2004/0107536 A1 * 6/2004 Hollenstein ..... 16/94 R
2005/0093406 A1 * 5/2005 Yang ..... 312/333

FOREIGN PATENT DOCUMENTS

AT 401716 B 11/1996
DE 29701895 U1 4/1997
DE 20217975 U1 3/2003

* cited by examiner

*Primary Examiner*—Janet M. Wilkens
*Assistant Examiner*—Timothy M. Ayres
(74) *Attorney, Agent, or Firm*—Wenderoth, Lind & Ponack, L.L.P.

(57) ABSTRACT

A retraction device for drawers includes a displaceable entrainment member (12) which is subjected to the force of two springs (14, 15) and which can be releasably coupled to a holding member (6) secured to a portion of an article of furniture. One of the springs (15) can be releasably coupled to the entrainment member (12) and one spring (14) is constantly connected to the entrainment member (12).

20 Claims, 10 Drawing Sheets

7
7'
8
20
21
17
A
10
16
4
15

7
8
20
21
17
9
10
16
4
15

8
7
9
10
25
16
24
22
17
4
7'
15

8
24
17
9
10
16
15
18
7
7'
4
15

7
1
12
20
14
5
15

7
12
16
14
5
15

12
16
1
14
5
15

RETRACTION DEVICE FOR DRAWERS

FIELD OF THE INVENTION

The invention relates to a retraction device for drawers or the like comprising a displaceable entrainment member which is subjected to the force of at least two springs and which can be releasably coupled to a holding member secured to a portion of an article of furniture.

A retraction device of that kind is known from German utility model DE 202 17 975 U.

SUMMARY OF THE INVENTION

The object of the invention is to improve a retraction device of that kind, such that it has a more uniform retraction characteristic and also a retraction capability which is still strong in the last range of closing movement.

The object according to the invention is attained in that at least one of the springs can be releasably coupled to the entrainment member and at least one spring is constantly connected to the entrainment member.

It is advantageously provided that the springs are of an unequal length.

In general a drawer of that kind will be provided with two springs. When the drawer is pulled out firstly both springs are stressed, then the shorter spring is unlatched from the entrainment member and anchored in the stressed condition in the housing in which the entrainment member is displaceable. Upon further extension movement of the drawer, the longer spring is then alone further stressed until that spring, together with the entrainment member, is anchored in a stressed condition in the housing. The drawer can then be freely pulled further out of the body of the article of furniture.

When the drawer is pushed in, the holding member comes into engagement in a known manner at the entrainment member, releases it from its anchored condition on the housing and the drawer is first pulled into the body of the article of furniture only by one spring. The stress in the spring decreases over the retraction travel distance. When the stress in the spring has reached a predetermined lower value the second spring is coupled to the entrainment member and the drawer is now pulled into the body of the article of furniture by both springs jointly. The drop in spring stress or the drop in force in respect of the first spring is compensated by the use of the second spring.

A further embodiment of the invention provides that the entrainment member is mounted on a linearly displaceable slider which is engaged by a coupling member which is fixedly connected to at least one spring. Mounted in the coupling member is a rocker member which serves as a locking member and which arrests the coupling member on the one hand to the slider and on the other hand to the housing.

BRIEF DESCRIPTION OF THE DRAWINGS

An embodiment of the invention is described hereinafter with reference to the Figures of the accompanying drawings in which.

DETAILED DESCRIPTION OF PREFERRED EMBODIMENTS

Figure 2:
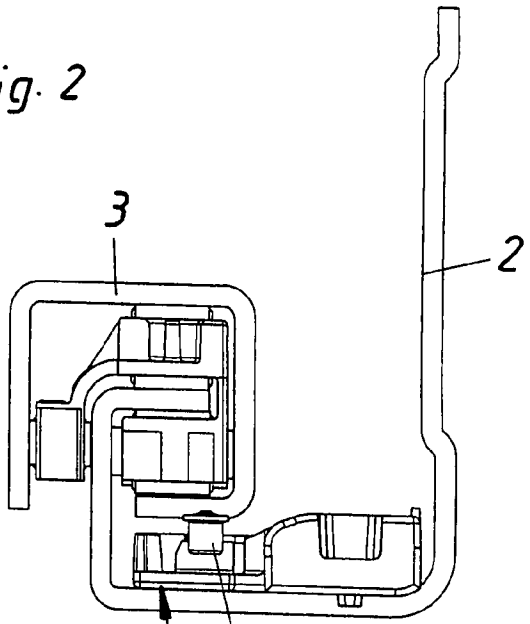
FIG. 2 shows an end view of a retraction device according to the invention.
Figure 1:
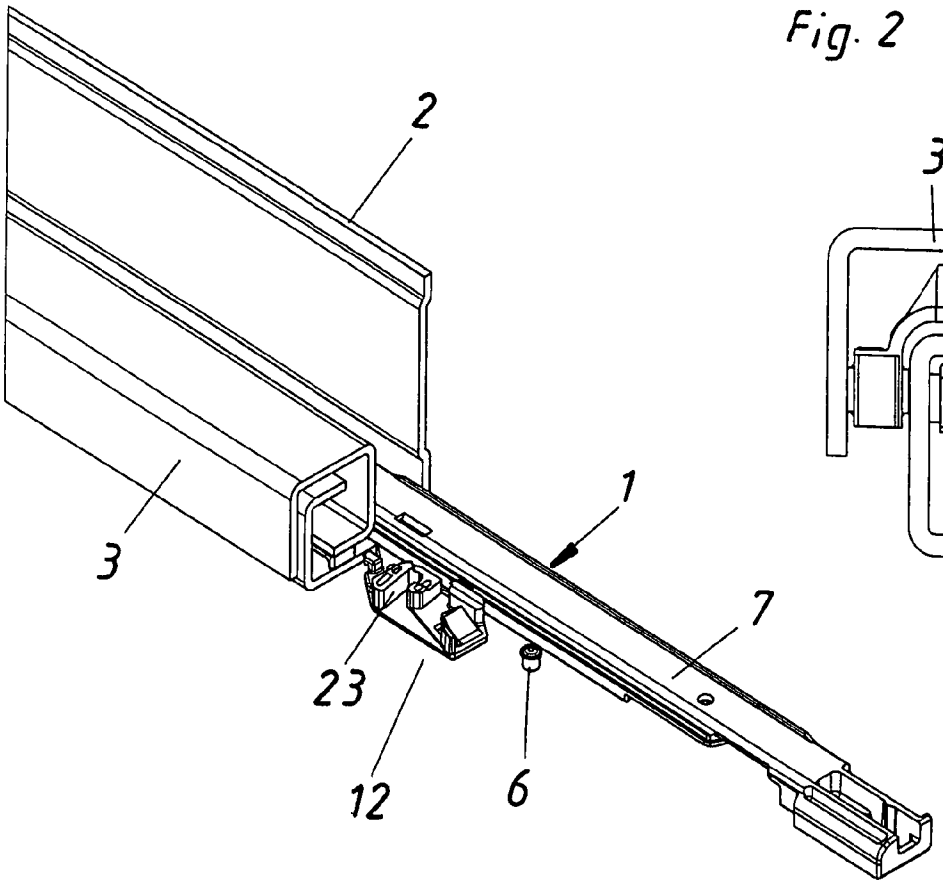
FIG. 1 is a diagrammatic perspective view of an extension guide fitting with a retraction device according to the invention.
Figure 4:
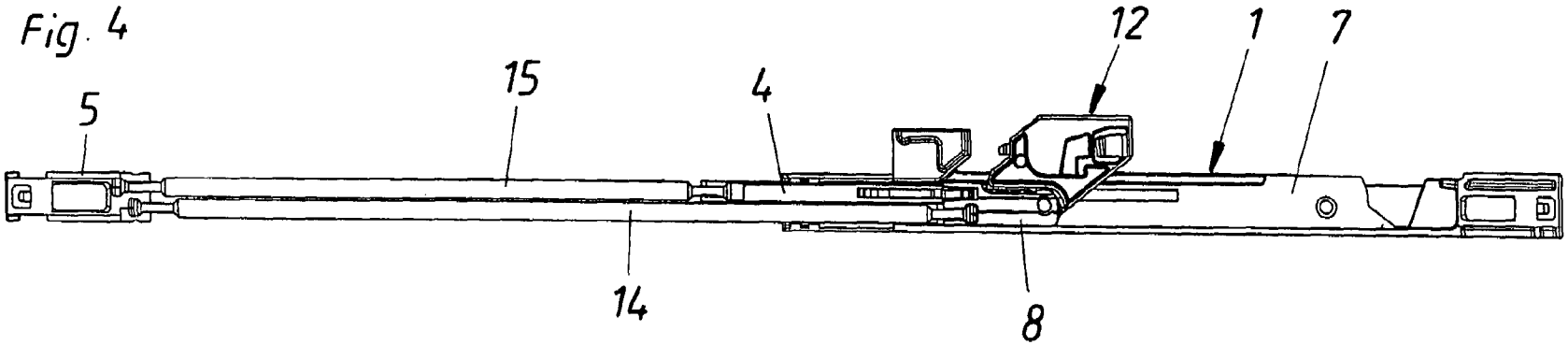
FIG. 4 is a view of the retraction device according to the invention seen from below.
Figure 3:
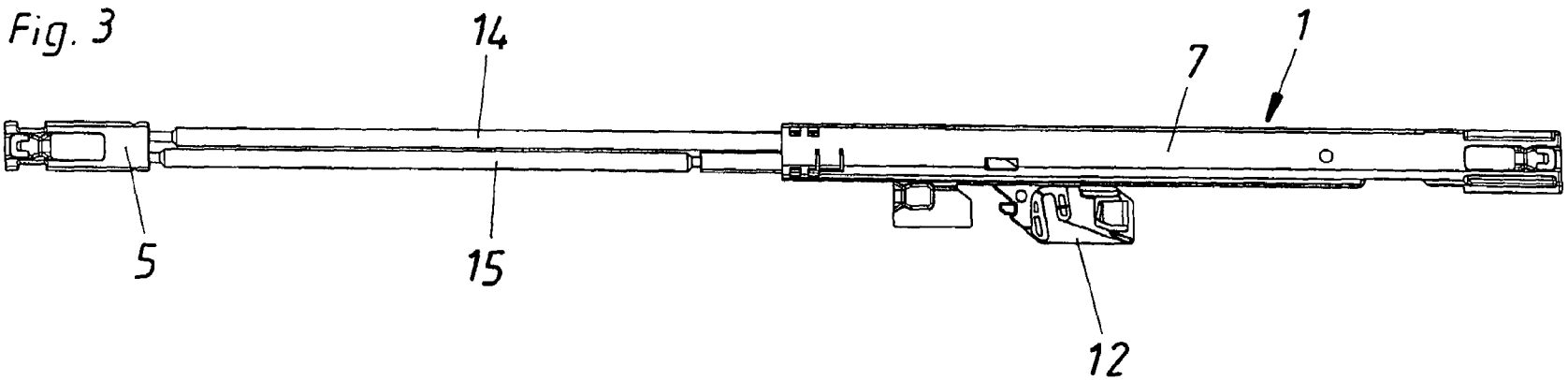
FIG. 3 shows a plan view of a retraction device according to the invention.
Figure 5:
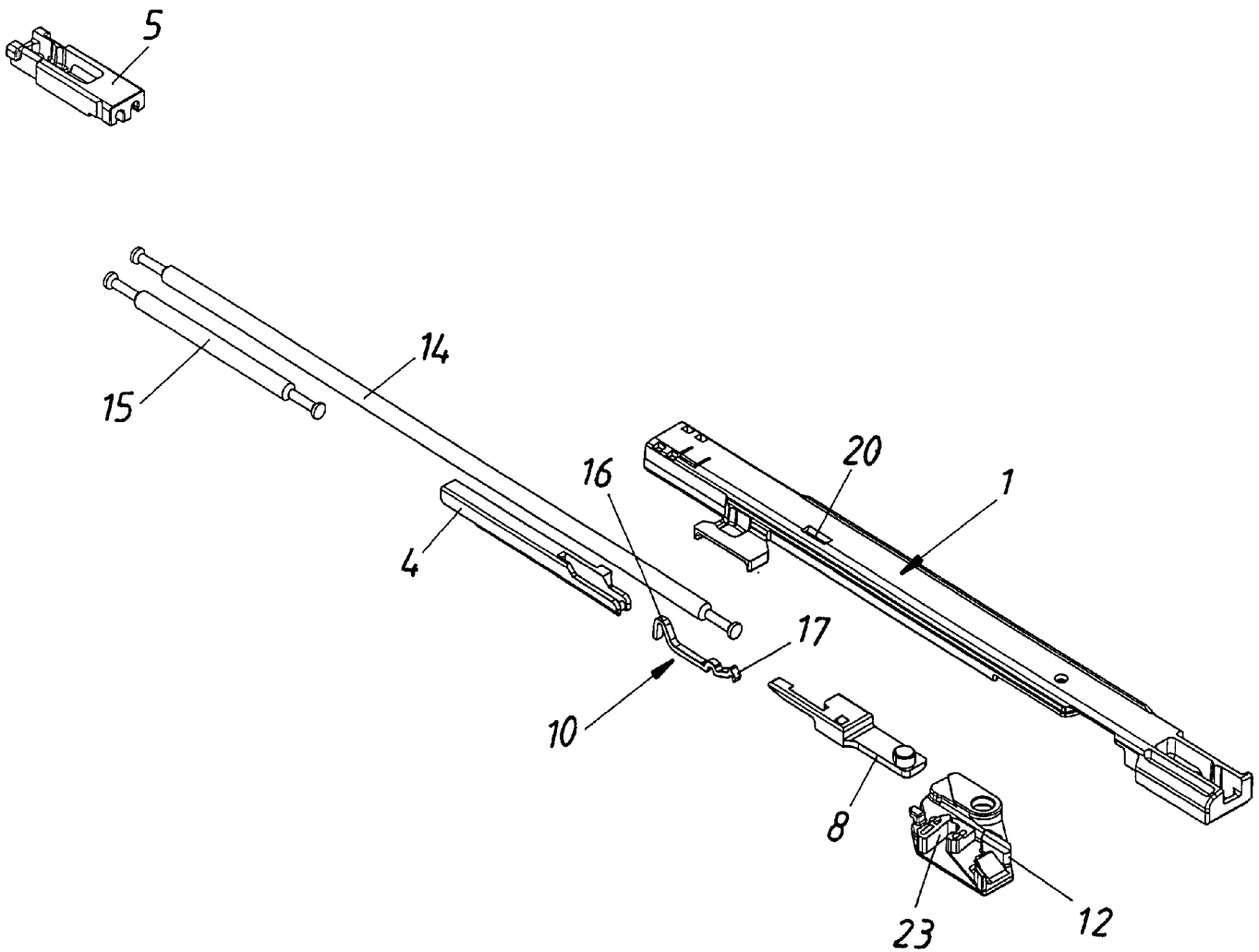
FIG. 5 shows an exploded perspective view of the retraction device according to the invention.

In the illustrated embodiment the retraction device 1 is mounted on the carrier rail 2 of an extension guide fitting. The carrier rail 2 is to be secured to a side wall of a body of an article of furniture in a conventional manner. An extension rail 3 is secured to each side of the drawer. Arranged on the extension rail 3 at the drawer side is a downwardly projecting entrainment pin 6 forming the holding member with which the entrainment member 12 of the retraction device 1 can be releasably coupled.

The retraction device 1 has a housing 7 which is anchored on a horizontal limb of the carrier rail 2. The arrangement also has an anchoring member 5 for first and second springs 14, 15, which is also anchored on the horizontal limb of the carrier rail 2. Upon being mounted on the carrier rail 2, the housing 7 and the anchoring member 5 are spaced from each other. The spacing between the housing 7 and the anchoring member 5 determines the stress of the springs 14, 15 and thus the retraction force of the retraction device 1. The ends of the springs 14, 15 are fixedly connected to the anchoring member 5.

The entrainment member 12 of the retraction device 1 is mounted on a slider 8 which is arranged displaceably in the housing 7, and is in the form of a tilting member. The entrainment member 12 has a projection, by means of which it is guided on a guide track of the housing 7.

The first and second springs 14, 15 are anchored on one end to the anchoring member 5 and on the other end to the slider 8. The spacing of the anchoring member 5 from the housing 7, as stated above, determines the stress of the springs 14, 15. The housing 7 is of a U-shaped cross-section and in the mounted condition covers the springs 14, 15 partially and the slider 8 entirely.

The illustrated embodiment has two springs 14, 15 which are in the form of coil tension springs and which are disposed in a mutually juxtaposed relationship in a plane which is parallel to the mounting plane of the housing 7. The term mounting plane is used to denote the plane in which the housing 7 is supported on the horizontal limb of the carrier rail 2.

When a stronger retraction force is required, it is also possible to use three or more springs. The height (the dimension perpendicular to the horizontal limb of the carrier rail 2) of the housing 7 remains unchanged, and for that reason the retraction device 1 can also be installed in very low extension guide fittings.

The first spring 14 remains constantly connected to the slider 8 (and, therefore, to the entrainment member 12). The second spring 15, however, is releasably coupled to the entrainment member 12 by a releasing mechanism including a coupling member 4, a rocker member 10, and the slider 8. Specifically, the second spring 15 is anchored to the coupling member 4, on which the rocker member 10 of the releasing mechanism is mounted tiltably on a spindle 9.

The rocker member 10 has two latching noses 16, 17. The latching nose 16 is 5 provided with an abutment surface 18.

The rocker member 10 couples the coupling member 4 either to the carriage 8 or to the housing 7.

Figures 6, 7, 8, 9:
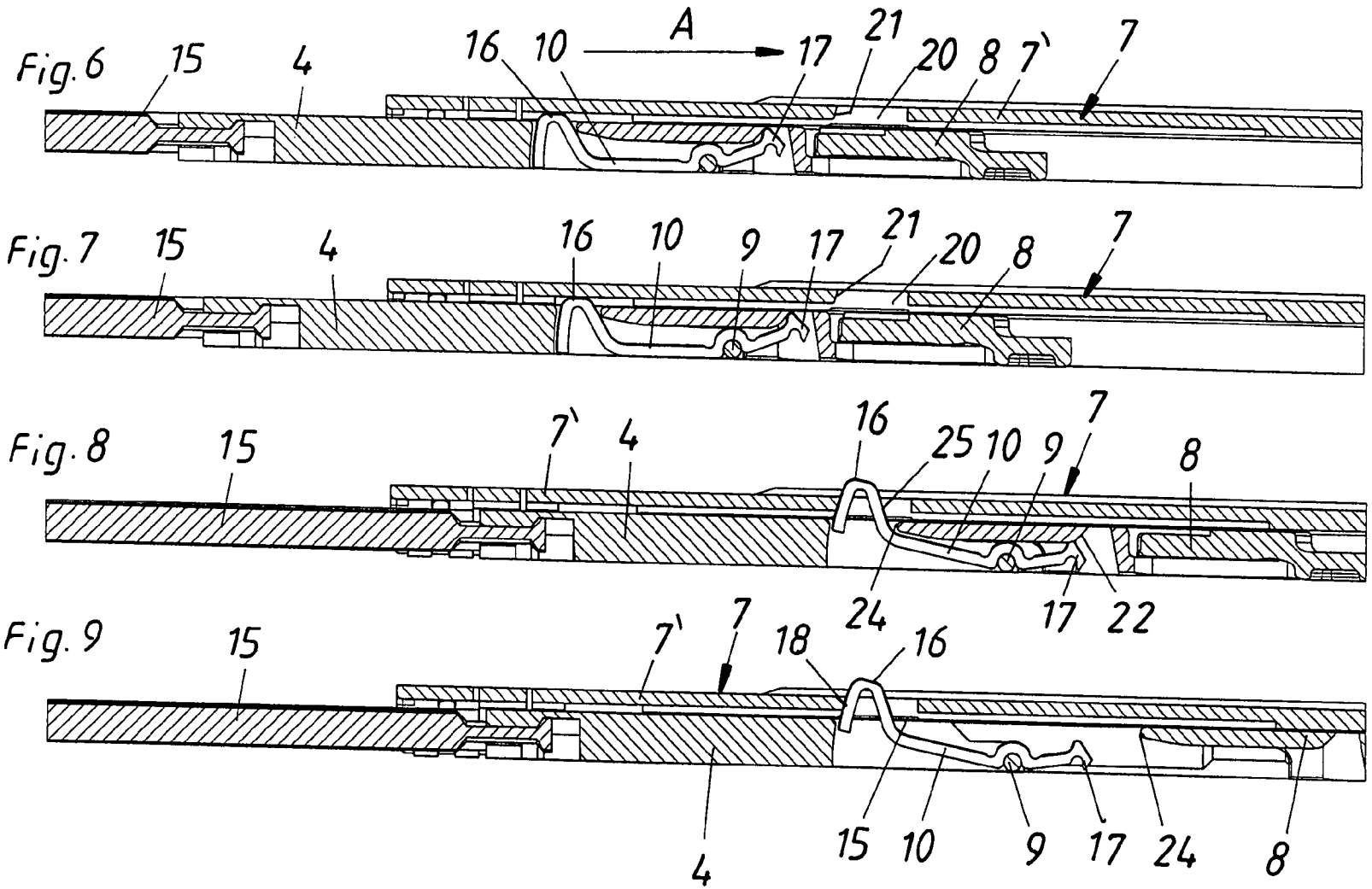
FIGS. 6 through 9 show views in longitudinal section through the retraction device according to the invention, the entrainment member and the coupling member being shown in various positions.
Figures 10, 11, 12:
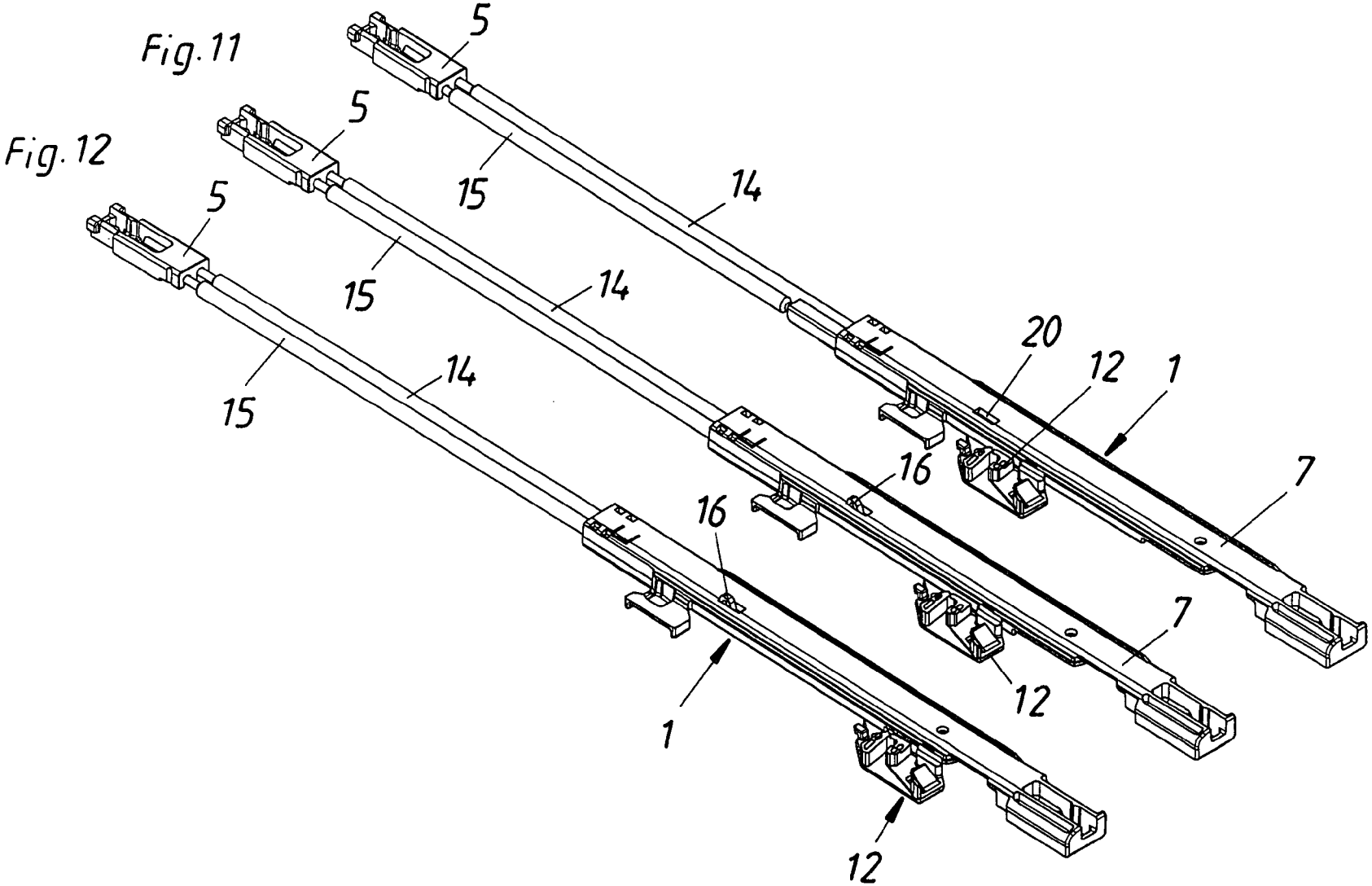
FIGS. 10 through 12 show perspective views of the retraction guide fitting according to the invention, corresponding to sections 6 through 9.
Figure 13:
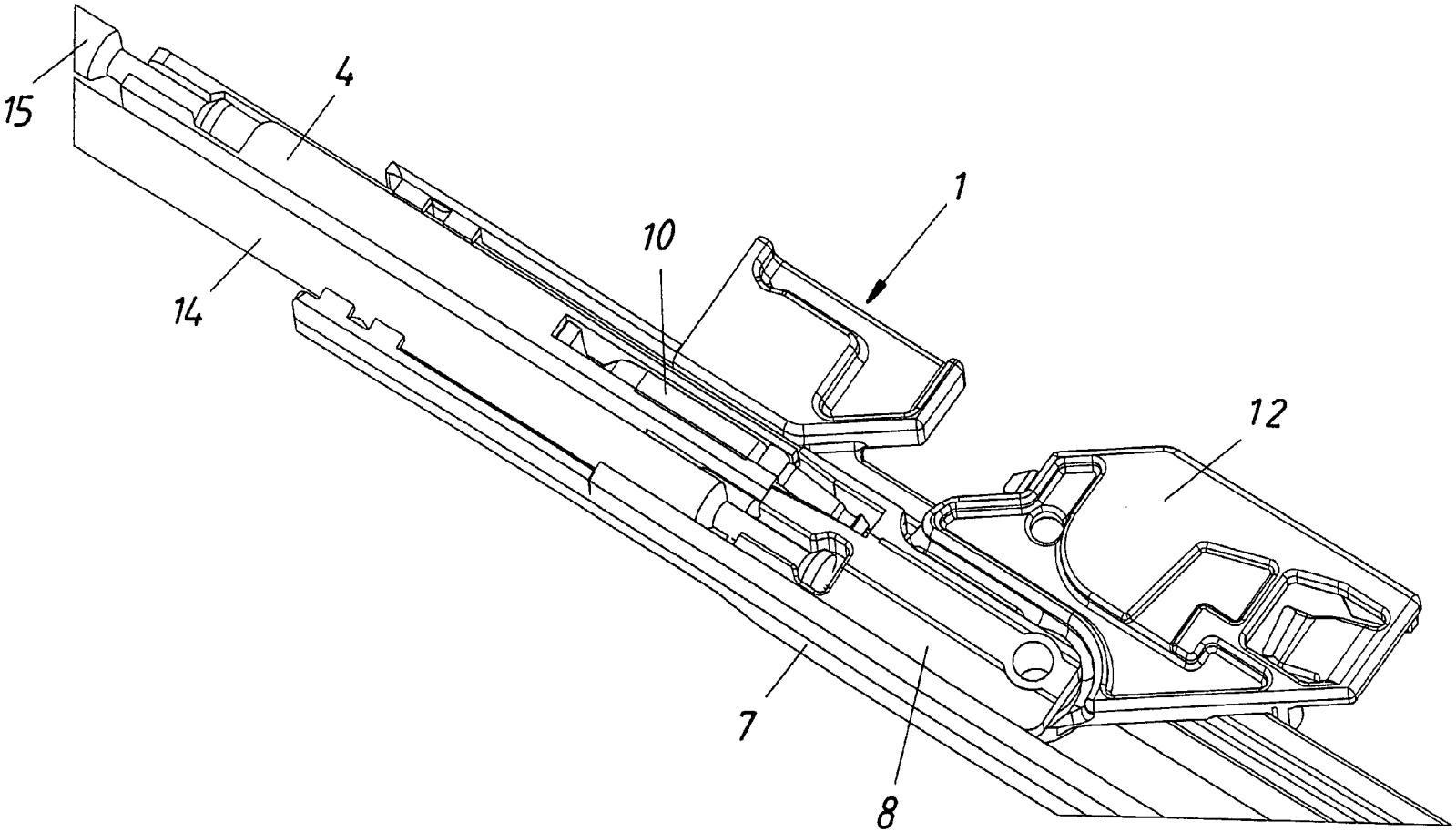
FIG. 13 shows a perspective view of the retraction device according to the invention seen from below, the entrainment member being shown at the rearmost end of the retraction travel distance.
Figure 14:
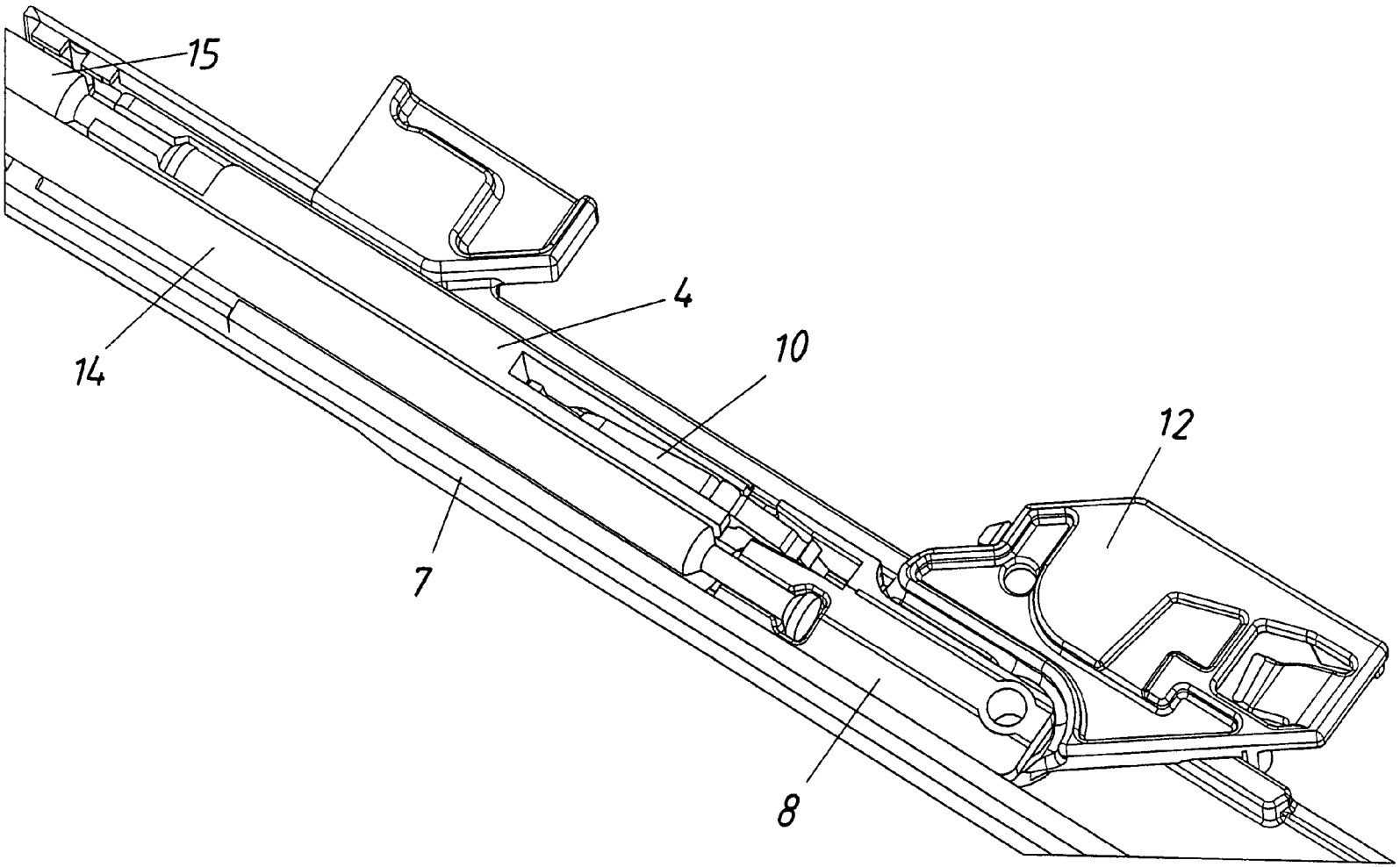
FIG. 14 shows the same perspective view as FIG. 13, with the entrainment member being shown during the displacement travel.
Figure 15:
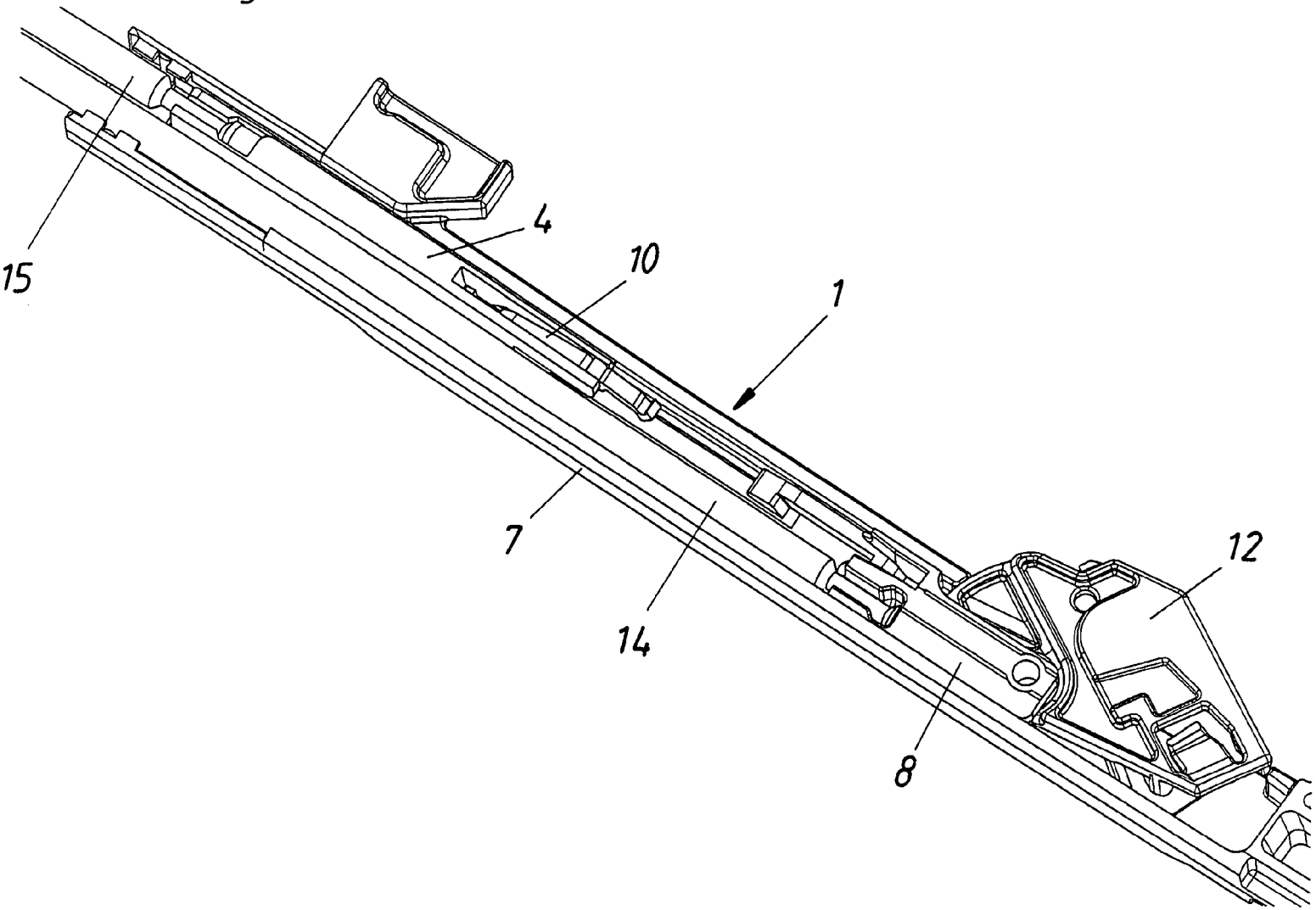
FIG. 15 shows the same perspective view as FIGS. 12 and 13, the springs being stressed and the entrainment member being shown in its readiness position.
Figure 16:
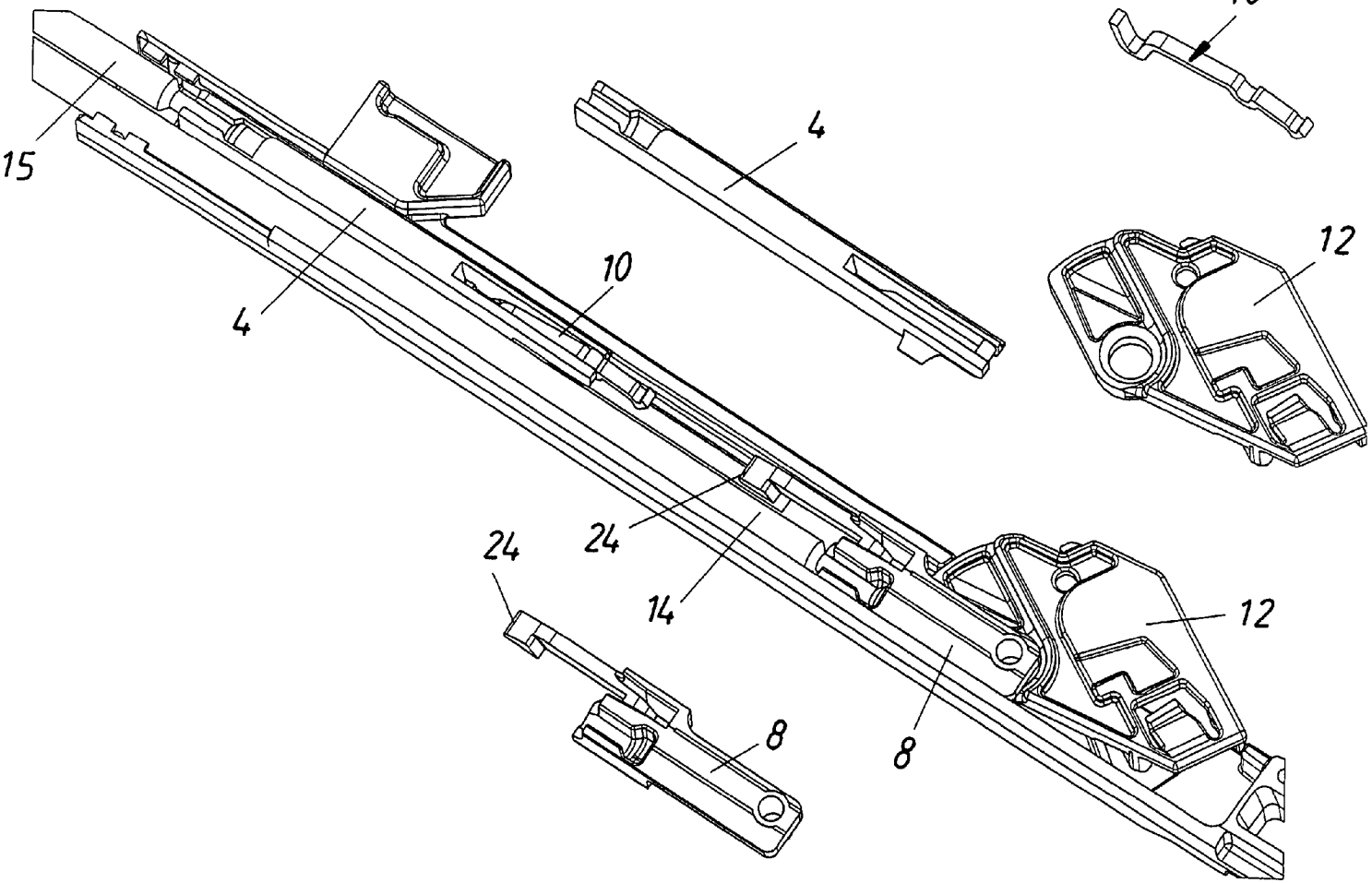
FIG. 16 shows a perspective view of the retraction device, the movable members being shown separately, with the exception of the springs, and FIG. 17 diagrammatically shows the function of the retraction device according to the invention.
Figure 17:
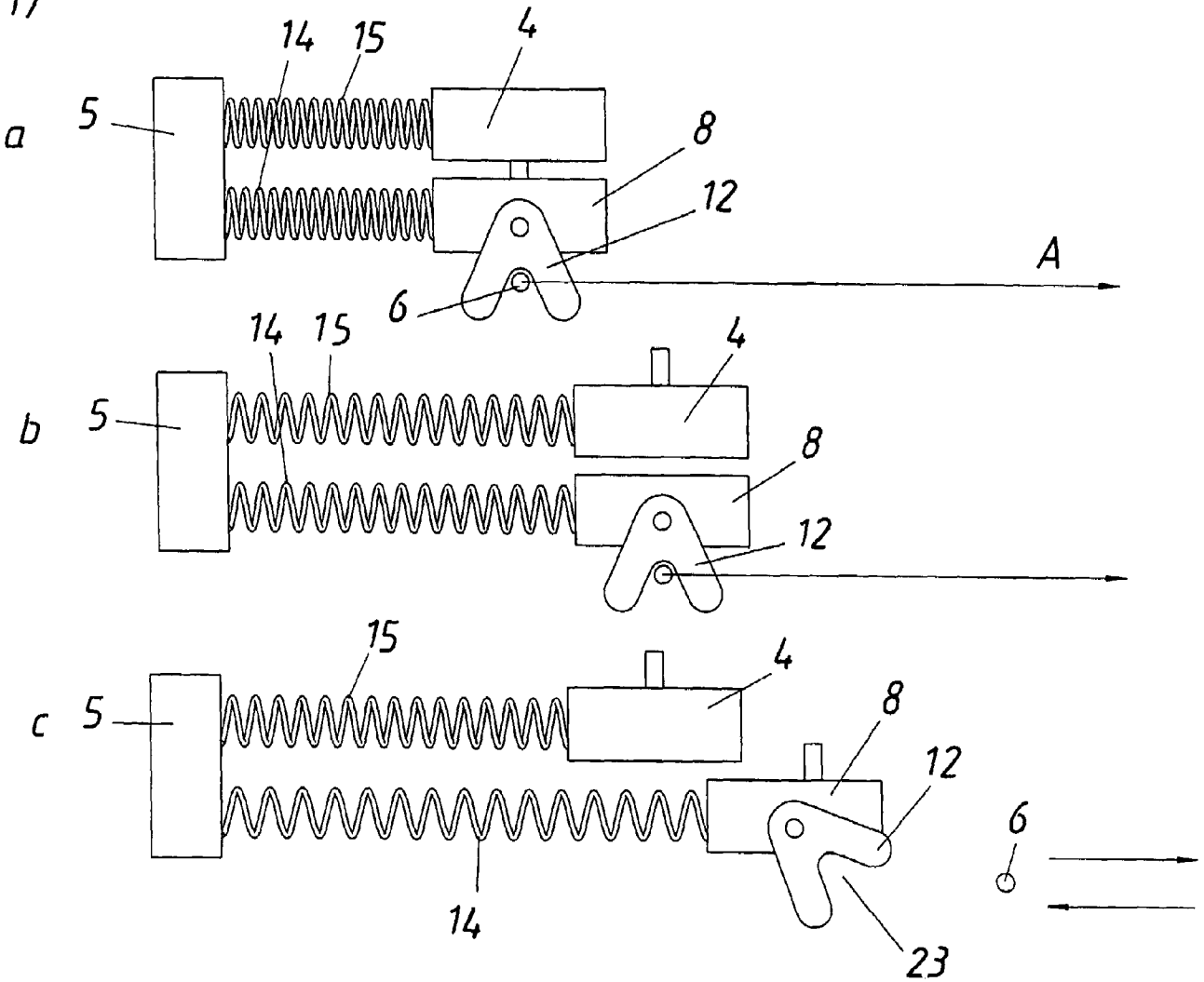

In FIGS. 6, 10 and 17 the parts of the retraction device are anchored in the initial position, that is to say the springs 14, 15 are relieved of stress and the second spring 15 is is connected to the slider 8 by way of the coupling member 4 of the releasing mechanism and the rocker member 10. The holding member 6 of the extension rail 3 is anchored in the entrainment member 12.

If now the drawer and thus the extension rail 3 are pulled out of the body of the article of furniture, the holding member 6 pulls the entrainment member 12 together with the slider 8 and the coupling member 4 anchored thereon in the direction of the arrows A in FIGS. 6, 10 and 17, the springs 14 and 15 being stressed. In that case the rocker member 10 of the releasing mechanism is engaged with the latching nose 17 at a holding surface 22 of the slider 8. The rocker member 10 is held in that position by the upper closure wall 7' of the housing 7.

The housing 7 has an opening 20 in its upper closure wall 7'. As soon as the latching nose 16 is below that opening 20, the rocker member 10, by virtue of the force which acts on the latching nose 17, is tilted in the clockwise direction and, as shown in FIG. 8, the latching nose 16 latches in the opening 20, in which case the abutment surface 18 bears against a counterpart surface 21 of the opening 20 or the housing 7.

Due to that rotary movement of the rocker member 10 of the releasing mechanism, the latching nose 17 releases the holding surface 22 and the slider 8 is uncoupled from the coupling member 4 while the coupling member 4 is anchored by way of the rocker member 10 to the housing 7. The second spring 15 is so-to-speak parked in the stressed position. The entrainment member 12 and the slider 8 are moved further, in which case the first spring 14 is further stressed. As soon as the entrainment member 12 has reached its end position, it is pivoted by virtue of the angled configuration of the control track in the housing 7 and releases the holding member 6. The drawer is now moved freely along the carrier rails and the retraction device 1 remains in the readiness position.

When the drawer is closed and the holding member 6 latches in the opening 23 of the entrainment member 12, the entrainment member 12 is tilted out of its latching position and pulled by way of the slider 8 by the first spring 14 into the body of the article of furniture. During the retraction travel the tension and thus the force of the spring 14 decreases. When the slider 8 has reached the position shown in FIG. 8 the nose 24 of the slider 8 bears against a counterpart surface 25 of the rocker member 10 of the releasing mechanism and the latching nose 16 of the rocker member 10 is urged out of the opening 20, in which case the holding effect between the abutment surfaces 18, 21 is nullified. At the same time the latching nose 17 of the rocker member 10 engages behind the holding surface 22 of the slider 8 and the coupling member 4 of the releasing mechanism is thus coupled by way of the rocker member 10 to the slider 8. The second spring 15 now also acts on the slider 8 and thus on the entrainment member 12 and the drawer is pulled jointly by the springs 14, 15 into the body of the article of furniture, into its rearmost position. The loss of stress in the first spring 14 over the retraction travel distance is cancelled out by the second spring 15 being brought into effect and the drawer is very uniformly pulled into the body of the article of furniture.

In its front region the coupling member 4 is of a U-shaped cross-sectional configuration and in that region the rocker member 10 is mounted on a spindle 9.

In the illustrated embodiment the retraction device 1 is arranged on the stationary carrier rail 2 and the entrainment pin 6 is arranged on the extension rail 3 which is towards the drawer. The reversed arrangement, that is to say the retraction device 1 on the extension rail 3 and the entrainment pin 6 on the carrier rail 2, would also be possible.

The invention claimed is:

1. A pull-out guide assembly for drawers, comprising:

a carrier rail to be mounted to an article of furniture;

an extension rail to be mounted to a drawer, said extension rail being displaceable relative to said carrier rail;

a holding member fixed to said extension rail;

a housing fixed to said carrier rail;

an entrainment member releasably coupled to said holding member, said entrainment member being displaceable within said housing;

a first spring having a first end fixed to said entrainment member, and having a second end anchored to said carrier rail; and a second spring having a first end releasably coupled to said entrainment member by a releasing mechanism, and having a second end anchored to said carrier rail, wherein said releasing mechanism releases said first end of said second spring from said entrainment member while said entrainment member moves along a path of movement.

2. The pull-out guide assembly according to claim 1, wherein a length of said first spring at rest is different than a length of said second spring at rest.

3. The pull-out guide assembly according to claim 2, wherein said releasing mechanism includes:

a coupling member fixed to said first end of said second spring for releasably coupling said first end of said second spring to said entrainment member;

a rocker member mounted in said coupling member; and a linearly displaceable slider, said entrainment member being mounted on said slider, and said coupling member being releasably connected with said slider, wherein said slider includes a control nose for tilting said rocker member so as to releasably couple said coupling member to said slider.

4. The pull-out guide assembly according to claim 1, wherein said releasing mechanism includes a coupling member for releasably coupling said first end of said second spring to said entrainment member, said coupling member being fixed to said first end of said second spring, and said coupling member being operable to alternately couple said first end of said second spring to said entrainment member or said housing.

5. The pull-out guide assembly according to claim 4, wherein said releasing mechanism further includes a slider arranged so as to be linearly displaceable in said housing, said entrainment member being mounted on said slider, and said coupling member being releasably connected with said slider.

6. The pull-out guide assembly according to claim 5, wherein said releasing mechanism includes a rocker member mounted in said coupling member, and wherein said slider includes a control nose for tilting said rocker member so as to releasably couple said coupling member to said slider.

7. The pull-out guide assembly according to claim 4, wherein said releasing mechanism further includes a rocker member mounted in said coupling member.

8. The pull-out guide assembly according to claim 7, wherein said releasing mechanism includes:

a linearly displaceable slider, said entrainment member being mounted on said slider, and said coupling member being releasably connected with said slider, wherein said rocker member includes a first latching nose and a second latching nose, and wherein said coupling member, said rocker member, said slider and said housing are structured and arranged such that said coupling member is releasably connected with said slider by said rocker member when said second latching nose of said rocker member is engaged with a holding surface of said slider, and such that said first latching nose engages a holding surface of said housing upon said coupling member being released from said slider by said second latching nose being disengaged from said holding surface of said slider.

9. The pull-out guide assembly according to claim 8, wherein said holding surface of said slider is in the form of a control cam.

10. The pull-out guide assembly according to claim 9, wherein said slider includes a control nose for tilting said rocker member so as to releasably couple said coupling member to said slider.

11. The pull-out guide assembly according to claim 8, wherein said holding surface of said slider is provided at an opening in said slider, and said holding surface of said housing is provided at an opening in said housing.

12. The pull-out guide assembly according to claim 8, wherein said rocker member is tiltably mounted on a spindle in said coupling member.

13. The pull-out guide assembly according to claim 12, wherein said slider includes a control nose for tilting said rocker member so as to releasably couple said coupling member to said slider.

14. The pull-out guide assembly according to claim 8, wherein said slider includes a control nose for tilting said rocker member so as to releasably couple said coupling member to said slider.

15. The pull-out guide assembly according to claim 7, wherein said rocker member is tiltably mounted on a spindle in said coupling member.

16. The pull-out guide assembly according to claim 15, wherein said releasing mechanism includes a linearly displaceable slider, said entrainment member being mounted on said slider, and said coupling member being releasably connected with said slider, wherein said slider includes a control nose for tilting said rocker member so as to releasably couple said coupling member to said slider.

17. The pull-out guide assembly according to claim 7, wherein said coupling member includes a region having a U-shaped cross section in which said rocker member is mounted.

18. The pull-out guide assembly according to claim 7, wherein said releasing mechanism includes a linearly displaceable slider, said entrainment member being mounted on said slider, and said coupling member being releasably connected with said slider, wherein said slider includes a control nose for tilting said rocker member so as to releasably couple said coupling member to said slider.

19. The pull-out guide assembly according to claim 4, wherein said releasing mechanism includes:

a rocker member mounted in said coupling member; and a linearly displaceable slider, said entrainment member being mounted on said slider, and said coupling member being releasably connected with said slider, wherein said slider includes a control nose for tilting said rocker member so as to releasably couple said coupling member to said slider.

20. The pull-out guide assembly according to claim 1, wherein said releasing mechanism includes:

a coupling member fixed to said first end of said second spring for releasably coupling said first end of said second spring to said entrainment member;

a rocker member mounted in said coupling member; and a linearly displaceable slider, said entrainment member being mounted on said slider, and said coupling member being releasably connected with said slider, wherein said slider includes a control nose for tilting said rocker member so as to releasably couple said coupling member to said slider.

* * * * *